US009238922B2

(12) United States Patent
Intagliata et al.

(10) Patent No.: US 9,238,922 B2
(45) Date of Patent: Jan. 19, 2016

(54) GROUND ANCHOR FOR FLEXIBLE DELINEATOR

(71) Applicant: ENERGY ABSORPTION SYSTEMS, INC., Dallas, TX (US)

(72) Inventors: John Intagliata, Antelope, CA (US); Kent Kekeis, St. John, IN (US)

(73) Assignee: Energy Absorption Systems, Inc., Dallas, TX (US)

( * ) Notice: Subject to any disclaimer, the term of this patent is extended or adjusted under 35 U.S.C. 154(b) by 0 days.

(21) Appl. No.: 14/504,930

(22) Filed: Oct. 2, 2014

(65) Prior Publication Data

US 2015/0096260 A1 Apr. 9, 2015

Related U.S. Application Data

(60) Provisional application No. 61/886,380, filed on Oct. 3, 2013.

(51) Int. Cl.

| | |
|---|---|
| ***E04H 12/22*** | (2006.01) |
| ***E02D 27/42*** | (2006.01) |
| ***E04H 12/34*** | (2006.01) |

(52) U.S. Cl.

CPC ..... *E04H 12/2215* (2013.01); *E02D 27/42* (2013.01); *E04H 12/347* (2013.01)

(58) Field of Classification Search

CPC ..... E04H 12/2215; E04H 12/2223; E01F 9/0175; E01F 9/0117

USPC ..... 52/154, 155, 157; 404/9

See application file for complete search history.

(56) References Cited

U.S. PATENT DOCUMENTS

| | | | | |
|---|---|---|---|---|
| 4,522,530 | A | 6/1985 | Arthur | |
| 4,874,149 | A | 10/1989 | Miceli | |
| 5,709,366 | A | 1/1998 | Speece | |
| 5,749,180 | A | 5/1998 | Jewett et al. | |
| 7,472,874 | B2 * | 1/2009 | Gross et al. | 248/156 |
| 8,177,185 | B2 * | 5/2012 | Priegel | 248/539 |
| 8,322,678 | B2 | 12/2012 | Zhu et al. | |
| D679,457 | S * | 4/2013 | Chance et al. | D30/154 |
| 8,464,464 | B2 * | 6/2013 | Rosaen | 47/33 |
| 8,590,856 | B2 * | 11/2013 | Zhu et al. | 248/530 |
| 2009/0293379 | A1 | 12/2009 | Smith | |

* cited by examiner

*Primary Examiner* — Jeanette E Chapman
*Assistant Examiner* — Daniel Kenny
(74) *Attorney, Agent, or Firm* — Brinks Gilson & Lione

(57) ABSTRACT

A ground anchor for a delineator includes a unitary plastic body having a receptacle shaped and configured for connection to a delineator post and a ground engaging portion extending from the receptacle along a longitudinal axis. The ground engaging portion includes a plurality of tapered blades. Delineator assemblies using the ground anchor, and methods of installing the ground anchor, are also provided.

30 Claims, 9 Drawing Sheets

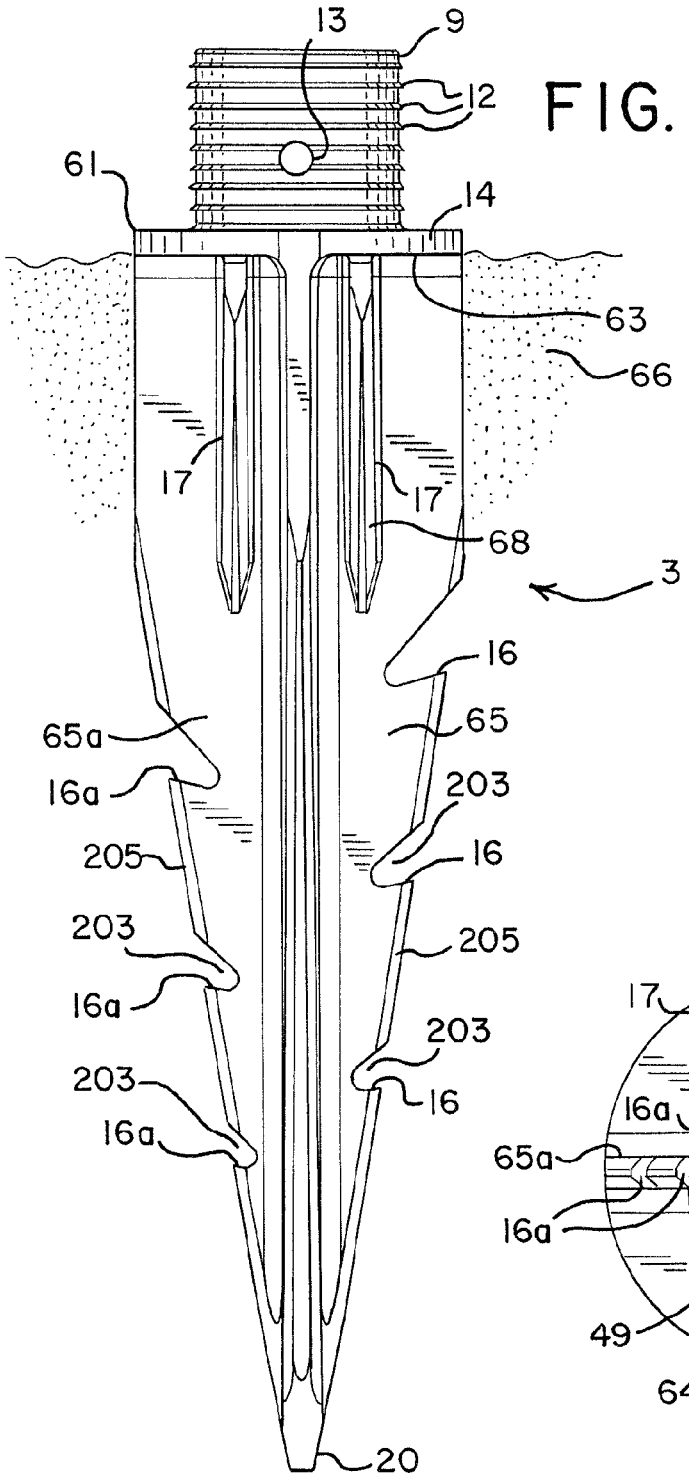
FIG. 4
FIG. 5
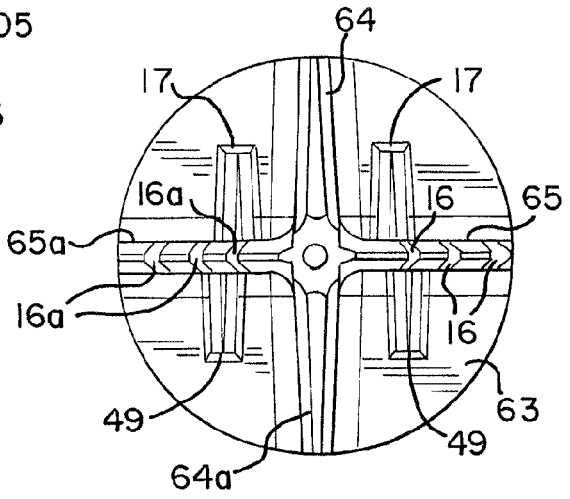

GROUND ANCHOR FOR FLEXIBLE DELINEATOR

This application claims the benefit of U.S. Provisional Application No. 61/886,380, filed Oct. 3, 2013, the entire disclosure of which is hereby incorporated herein by reference.

TECHNICAL FIELD

The present invention relates generally to ground anchors suitable for use with plastic flexible delineator poles.

BACKGROUND

Traditionally, delineator anchors are made from metal. With metal anchors, a series of machining, forming or welding operations may need to be performed to complete an assembly, which processes may be costly and labor intensive. For example, in U.S. Pat. No. 5,709,366, angle irons are positioned and welded together and a drive plate is secured with the help of a threaded element.

Some metal delineator anchors may also require multiple fasteners to assemble and thus are more costly from a manufacturing perspective. The joined areas of these delineator anchors may also be susceptible to failure due to high stresses experienced when the delineator is struck by a vehicle moving at high speeds. Additionally, metal parts are typically heavier than light-weight plastic, and thus cost more to ship.

Another type of delineator in use on the highways is a marker made from wood. Unlike flexible plastic delineators, wood markers do not return to a vertical position when struck by a vehicle, but rather typically are broken. In addition, such delineators are susceptible to splintering and cracking when being installed. Additionally, wood markers may deteriorate over time due to exposure of the elements, such as sun, rain, snow, etc. Wood markers may also be expensive to fabricate, since they require cutting and painting and the attachment of retro reflective material.

SUMMARY

In one aspect, one embodiment of a ground anchor for a delineator includes a unitary plastic body having a receptacle shaped and configured for connection to a delineator post and a ground engaging portion extending from the receptacle along a longitudinal axis. The ground engaging portion includes a plurality of tapered blades each having an edge, wherein at least one of the blades includes a cutout defining at least one barb, wherein the barb does not extend outwardly from the edge of the at least one blade.

In another aspect, a ground anchor for a delineator includes a unitary plastic body having a receptacle including a pair of concentric cylinders shaped and configured for connection to a delineator post and defining a drive platform, and a ground engaging portion extending from the receptacle along a longitudinal axis. The ground engaging portion comprising a plurality of tapered blades extending radially from a central axis and terminating at a pointed end portion.

In another aspect, a delineator post is coupled to and extends from the receptacle along the longitudinal axis.

In another aspect, a method of installing a ground anchor for a delineator includes positioning the ground engaging portion at a targeted location on a ground surface and applying a force with a driving tool against the driving platform and thereby driving the ground engaging portion into the ground.

In another aspect, a delineator system includes a ground anchor having a receptacle with a pair of concentric cylinders shaped and configured for connection to a delineator post. A delineator post is positioned in one of three positions including a first position surrounding an outer one of the concentric cylinders, a second position between the concentric cylinders and a third position inside an inner one of the concentric cylinders.

In another aspect, a driving tool includes a guide portion having a collar defining a cylindrical cavity shaped to receive an upper portion of a ground anchor. The guide portion has a bottom edge. A driving portion is coupled to the guide portion and extends downwardly into the cavity. The driving portion has a bottom end spaced above the bottom edge of the guide portion.

The anchor system provides various significant advantages over other anchor systems. For example and without limitation, an inexpensive and easy to install anchor for delineators is provided for use on roads and highways. The anchors can be installed in a wide variety of mediums, including any type of soil, such as hard, soft, sandy or wet soil. The system provides for a quick and accurate method of locating and installing the anchors, when configured either with or without a delineator post. The configuration and location of the barbs increases the strength of the anchors during the driving operation and the pull-out force required to dislodge them.

The delineators may hold retro reflective tape, signage or other indices to help guide and delineate motorists. Other applications for delineators are to mark boundaries, for example, in snow areas. The marked boundaries are useful to let snow plow operators know how far along the side of the road they need to plow. The delineators are flexible so that they yield readily when struck by a vehicle and then return to a substantially vertical position once the vehicle passes over.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 4 is a front plan view of the Anchor embedded in the soil.

FIG. 5 is a bottom view of the Anchor.

DETAILED DESCRIPTION OF THE PRESENTLY PREFERRED EMBODIMENTS

Figure 1:
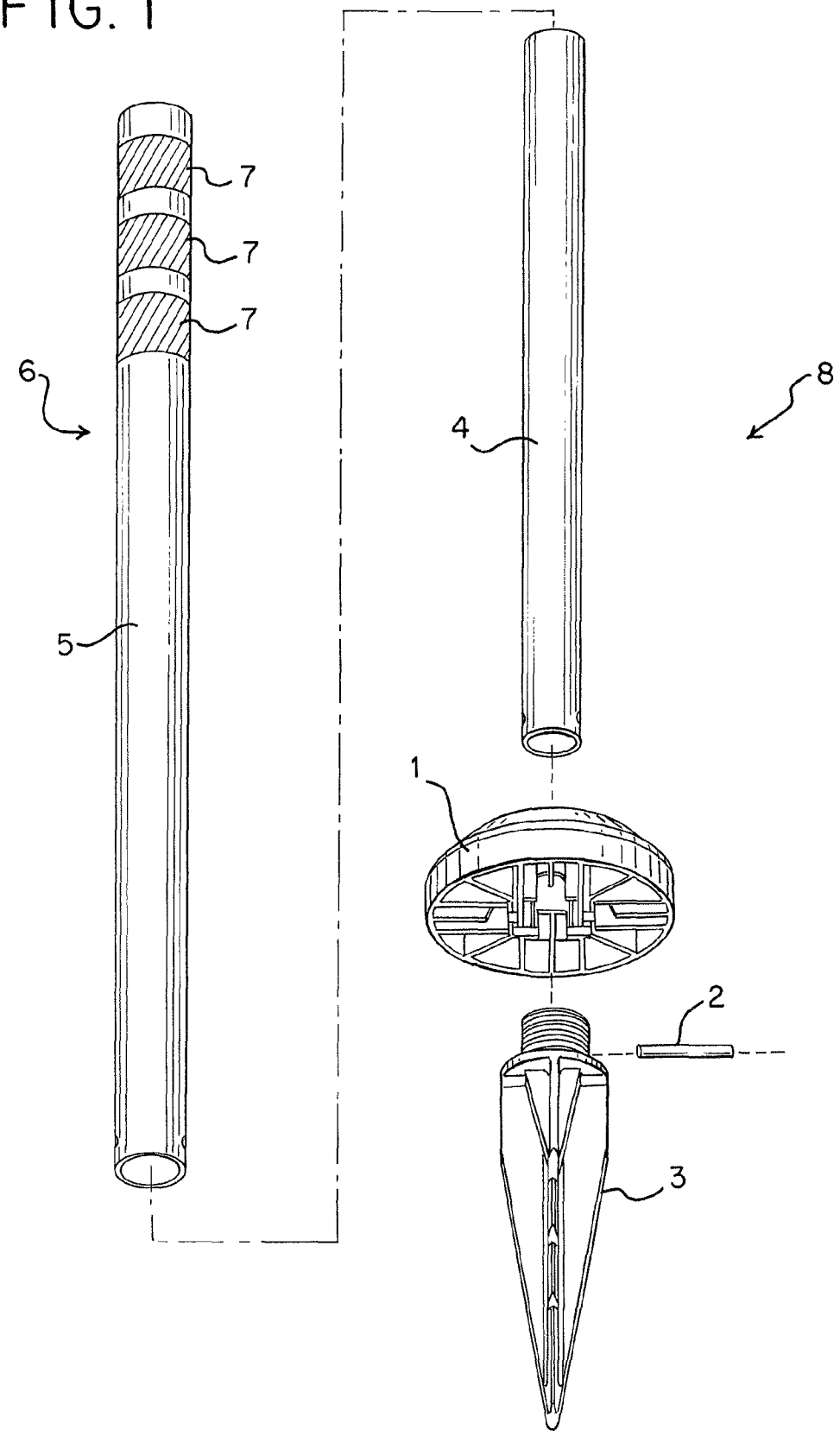
FIG. 1 is an exploded view of the delineator assembly with support collar.

It should be understood that the term "longitudinal," as used herein means of or relating to length or the lengthwise direction of a delineator and/or anchor. The term "lateral," as used herein, means directed toward or running perpendicular to the length of the delineator. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" may refer to any sequence of such delineator components, and is not limited to the first and second delineator components unless otherwise specified. The term "rigid" means the ability to resist relative movement between components. The term "flexible" means the ability of components to move relative to each other with little applied force. The term "plurality" means two or more, or more than one.

An anchor for use in roads, highways and also in snow areas is comprised of a light-weight, unitary, plastic body 3, or base. The anchor has a relative light weight by making the anchor body from strong, durable, light-weight plastic material. One such material that has these properties is High Impact Polystyrene, although other durable plastic materials may be suitable. The anchor body 3 is formed, in one embodiment, by the injection molding process. The injection molding process allows the parts to be made quickly and efficiently as a single unit with exacting, repeatable tolerances. The anchor may be made by other processes and from other types of materials, such as other polymers, metal or wood.

The anchor may be used to hold a single flexible delineator pole 4, 5 or a plurality of poles 4, 5 which are concentric with each other. Depending on the application and desired level of performance either one, two, three or more flexible delineator poles can be nested concentrically within each other. For example, a delineator post may be positioned in one of three positions including a first position surrounding an outer one of a pair of concentric cylinders 9, 10, a second position between the concentric cylinders and a third position inside an inner one of the concentric cylinders. Second and third posts may be positioned in the other or remaining positions. Additional posts may be positioned within or around the inner and outer posts. When struck by a vehicle the flexible delineator pole(s) will easily yield, allowing the vehicle to safely pass over. Once the vehicle passes, the delineator pole(s) will return to a substantially vertical position, enabling the system into a serviceable condition. Of course, the anchor 3 described herein could be used to hold other types of poles, including non-flexible types made from hard plastics, wood or metal.

In the event that the delineator pole(s) reach their serviceable life, they can easily be replaced with the anchor remaining embedded in the soil by simply removing the securing pin and placing new delineator pole(s) in their place.

The plastic anchor may be more weather resistant than fabricated metal products, which may rust, or wood products, which may rot or deteriorate with age when exposed to the elements. Plastic bodies also decrease the shipping and handling costs to a great extent. Moreover, if dislodged, a plastic anchor may be less likely to cause damage to a vehicle.

Figure 2:
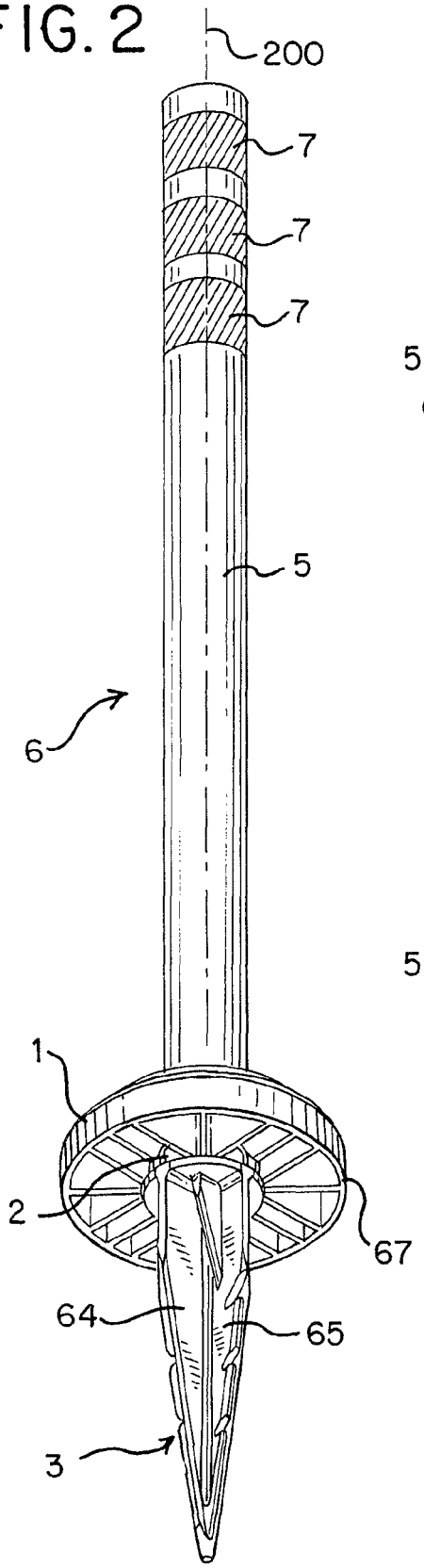
FIG. 2 is an isometric view of the delineator assembly with support collar.

Referring to FIGS. 1 and 2, embodiments of a system, method and apparatus for a flexible traffic delineator pole are shown. A traffic control assembly 8 for delineating or marking roadways or other marking areas is shown. The embodiment of the traffic control assembly 8 generally includes an anchor 3, a flexible inner delineator pole 4, a flexible outer delineator pole 5 with a reflective tape 7, steel spring roll pin 2 and a support collar 1. The anchor 3 is suitable to an inner delineator pole 4, outer delineator pole 5 or both. The inner delineator pole 4 has a smaller diameter than the outer delineator pole 5 so that the inner delineator pole 4 can nest inside the outer delineator pole 5. The delineator poles are made of low density polyethylene in one embodiment, although other durable plastic materials may be used. Retro-reflective tape 7 may be applied to outer delineator pole 5 to aid in making the delineator more visible to passing vehicles.

Figure 3:
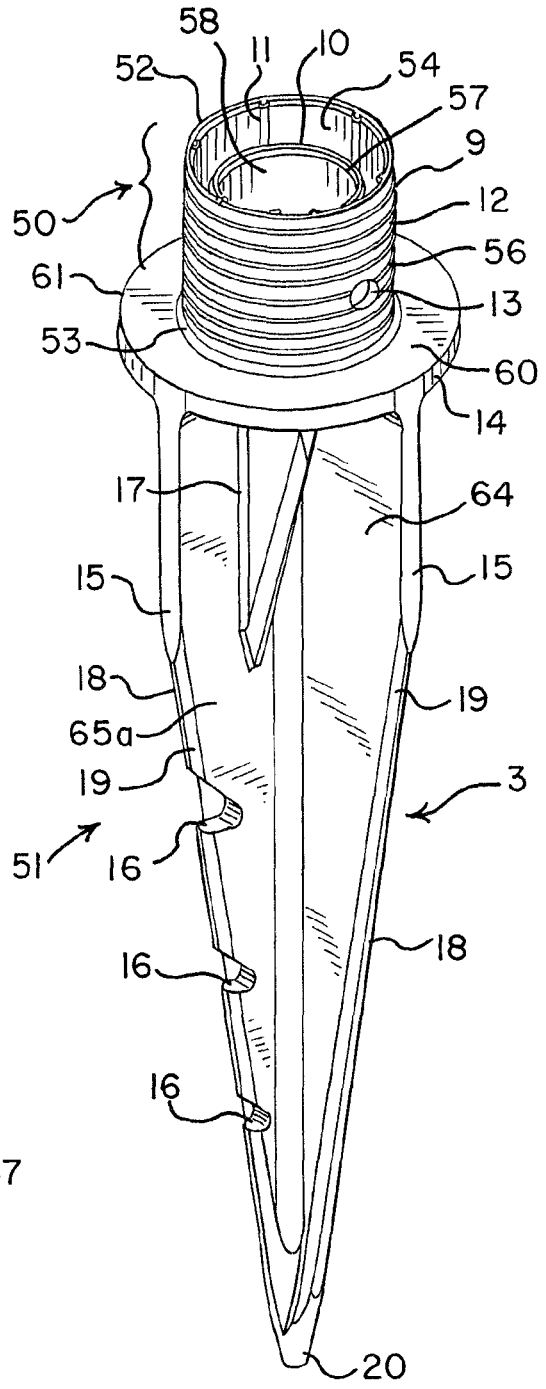
FIG. 3 is an isometric view of the Anchor.
Figure 6:
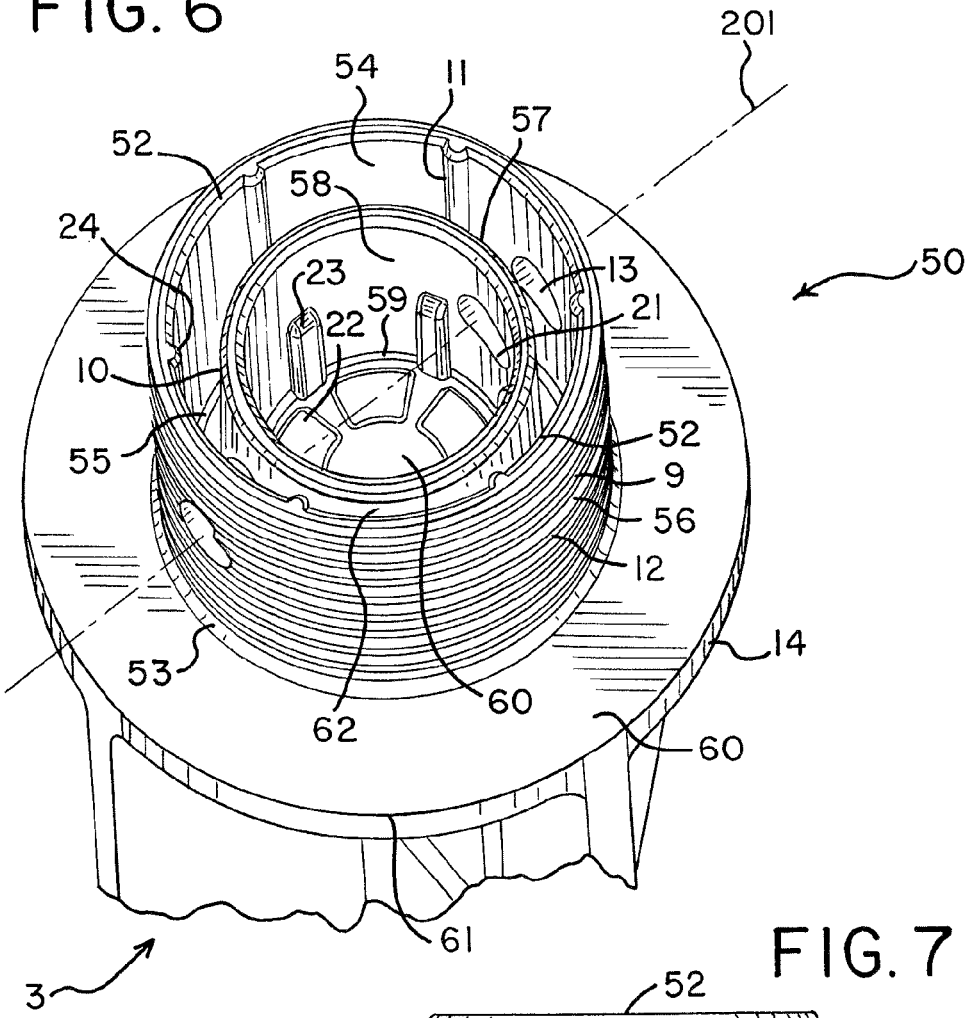
FIG. 6 is an enlarged perspective view of the receptacle section of the anchor.
Figure 7:
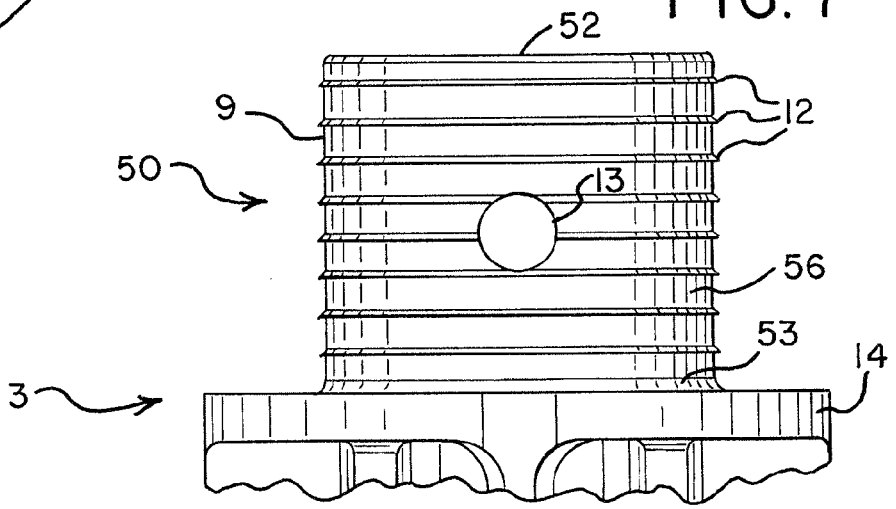
FIG. 7 is an enlarged front view of the receptacle section of the anchor.

FIGS. 3, 6 and 7 refers to the anchor 3 which can be used in roads, highways and also in snow areas. In one embodiment, the anchor is made of High Impact Polystyrene, although it may be made from other suitable materials such as other polymers, metal or wood. As mentioned, the anchor 3 may hold a single flexible delineator pole or plurality of poles which are concentric within each other. The anchor has an upper receptacle section 50 for attaching the pole(s) and a lower ground engaging section 51 to be driven vertically into the ground. The overall length of the anchor 3 is approximately 14 inches, of which the delineator pole connection section, or receptacle, is about 2 inches and the ground engaging section is about 12 inches in one embodiment, although dimensions, relative and absolute, may also be suitable. The anchor may be inserted into any type of soil, such as hard, soft or sandy soil. It has been observed that when the soil is wetted, the anchor may be easier to drive, even in soils classified as hard.

The anchor 3, otherwise referred to as a base, has an upper receptacle section for attaching the pole(s). The upper receptacle section 50 includes a pair of concentric cylinders, including an outer ring 9 and an inner ring 10, with a planar disc 61 connecting the cylinders. The outer ring 9 has a plurality of circumferential ridges 12 on its outer surface 56 useful for gripping the inside wall of the delineator 5. The circumferential ridges 12 are triangular in shape and protrude from the outer surface 56 of the outer ring 9. The sharp pointed ridges 12 are equally spaced and extend from the top surface 52 to the bottom surface 53. The inner surface 54 of the outer ring 9 has a plurality of longitudinal ribs 11 which extend from top surface 52 of the outer ring 9 to bottom surface 55 of the outer ring 9. The ribs 11 protrude from the inner surface wall 54 and are generally semi-circular in shape, but they could be rectangular or triangular or other shapes. In other embodiments, the base may include the upper receptacle portion, but may include a surface mounted assembly adapted to be mounted to the ground surface, rather than by way of an anchor. For example, the base may be bonded with adhesive to the ground, or may include other fasteners, and may be permanent or releaseable attachment.

The inner surface 58 of the inner ring 10 has a plurality of longitudinal ribs 23 that extend from the bottom surface 59 of the inner ring to about half way to the top surface 57 of the inner ring 10. These ribs 23 are generally rectangular in shape, but they could be circular or triangular or other shapes.

The receptacle section of the anchor may be approximately 2 inches in length, with the cylindrical rings 9, 10 extending along a longitudinal axis 200 while the rings extending upwards from the planar circular disc 61, which has a diameter of about 3.3 inches and is about ¼ inch thick in one embodiment. The two concentric rings accept two sizes of flexible delineator poles. The outer ring 9 is approximately 2 inches in diameter and the inner ring 10 is about 1.4 inches in diameter. There is a ¼ inch gap between the two concentric rings. The gripping ridges 12 on the outer surface grip the inside surface of the delineator pole 5. The circumferential ridges 12 are triangular in shape and protrude from the outer surface of the outer ring. The sharp pointed ridges are equally spaced by about 1/10 inches apart in one embodiment and are spaced apart between a top and a bottom of the outer ring.

The longitudinal ribs 11 extend from the top of the outer ring to the bottom of the outer ring. These ribs 11 protrude approximately 1/32 inches from the inner surface wall and are generally circular in shape, but they could be rectangular or triangular or other shapes. The ribs 11 allow for tolerances in the diameter of the delineator pole. Since the ribs are generally thin in width, they can push on the outside wall of the delineator tube 4 and compress a small portion of the tube. Conversely, in the absence of the ribs, the delineator tube may fit either too loose, if the tube is at its smallest in the tolerance range or too tight if the tube is at its largest size in the tolerance range. For example, if the diameter of the delineator pole is at largest tolerance range then the ribs will compress the outer surface of the delineator pole inwards the maximum amount.

The longitudinal ribs 23 extend from the bottom of the inner ring to about half way to the top of the inner ring. These ribs are generally rectangular in shape, but they could be circular or triangular or other shapes. The ribs 23 provide support for the outside surface of the drive tool rod. The presence of these ribs allows the overall wall thickness of the inner ring to be generally uniform with the other geometric features of the anchor; which facilitates the injection molding process.

On the top surface 60 of the planar disc 61 on the inside of the inner ring 10 there is a plurality of projections 22 that provide support to the anchor drive rod during installation of the anchor 3 in the soil. The projections 22 may be approximately 1/32 inches thick in one embodiment.

Holes 13, 21 accept a pin used for securing the delineator poles and are located in the receptacle section 50 of the anchor 3. The hole 13 is perpendicular to the longitudinal axis 200 of the anchor 3 and extends from one outer surface 56 of the outer ring 9 to the opposing outer surface 56 of the outer ring 9. Similarly, the axis of hole 21 is aligned with the axis of hole 13 and extends from one outer surface 62 of the inner ring 10 to the opposing outer surface 62 of the inner ring 10. In one embodiment the holes 13, 21 are ⅜ inches in diameter. The axis 201 of the holes is located approximately ⅝ inches from the top surface of the planar disc and is centered on the diameter of the concentric rings. The pin 2, which may be made of steel, secures the delineator pole(s) to the anchor. Of course the pin could be made from other materials, such as plastic. Alternatively, a plurality of pins could be used to secure the delineator poles to the anchor.

Figure 12:
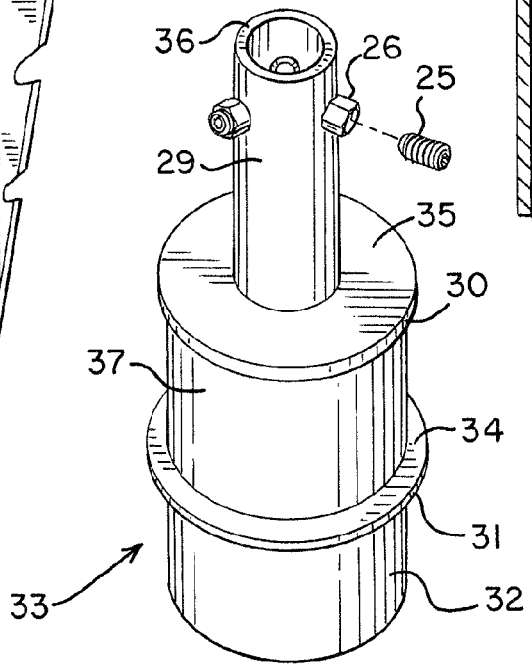
FIG. 12 is an isometric view of anchor installation guide tool.

Referring to the lower ground engaging section 51 of the anchor 3 as shown in FIGS. 3-5, four blades 64, 64*a*, 65, 65*a* in the shape of a plus sign extend downwardly from the lower surface 63 of the planar disc 61, and radially outwardly from the axis 200. Blades 64, 64*a* are oriented perpendicular to blades 65, 65*a*. The upper section edge 15 of the blades 64, 64*a* and 65, 65*a* are parallel to each other and to the longitudinal axis which enables a canister style driving tool 33 as shown in FIG. 12 to surround and engage the anchor 3 for added stability during installation. The canister driving tool 33 is explained in more detail below. The tapered section 18 of the blades 64, 64*a*, 65, 65*a* enable the anchor 3 to easily penetrate into the soil 66. The blades 64, 64*a*, 65, 65*a* taper, in one embodiment, at about a 10 degree angle with respect to the long axis and come to a terminal point 20. A chamfer 19 on the blades 64, 64*a*, 65, 65*a* also helps the anchor cut through the soil for easy penetration. Located on blades 65, 65*a* along the tapered section 18 are pluralities of barbs 16, 16*a* which extend or are open upwardly so as to help to grip the soil 66 once the anchor is embedded and thereby resist dislodgement. The barbs 16 on blade 65 are vertically offset from, or staggered relative to, the barbs 16*a* on blade 65*a*. The offset positioning helps to spread out the stress concentrations in the event of any lateral load that may be subjected to the anchor 3 during installation, and thereby increases the strength and stability of the anchors. The blades extend about 12 inches from the bottom surface of the planar disc, and are about ¼ inches thick in one embodiment. As mentioned, the blades are positioned 90 degrees to each other, although a greater or lesser number of blades and relative angular positioning may also be suitable. In one embodiment, the upper 2½ inches of the blades outer edges are parallel with the long axis of the anchor. The lower tapered section of the blades then taper at about a 10 degree angle with respect to the long axis and come to a point. As mentioned two of the opposing blades contain offset barbs to engage or grip the soil, although all of the blades, or some other combination thereof, may also be configured with barbs. The barbs are formed in the same plane as the blades by forming a cutout 203 in the edge 205 the blades, with the barbs therefore not protruding beyond the edge 205 of the blades Referring to FIG. 5, located on the bottom surface 63 of the planar disc 61 is a plurality of strengthening support ribs 17, 49. The ribs 17, 49 provide additional support to the striking area 22 of the anchor 3 shown in FIG. 6. The strengthening support ribs 17, 49 taper at an angle of about 10 degrees with respect to the anchor 3 long axis and terminate into the surface of the blades 64, 64*a*, 65, 65*a*. The outermost edge 68 shown in FIG. 4 of the strengthening support ribs is chamfered to help penetrate the soil easier. The vertical center line of the opposing ribs 17, 49 is offset by approximately the thickness of the ribs to maintain uniform wall thickness throughout the part. The ribs 17, 49 are about ¼ inch wide and 3 inches long in one embodiment and provide additional support to the striking area of the anchor. The ribs taper at an angle of about 10 degrees with respect to the anchor long axis and terminate into the surface of the blades. The vertical center lines of the opposing ribs are offset by approximately the width of the ribs to maintain generally uniform wall thickness throughout the part, as is desired when making parts with the injection molding process.

Figure 9:
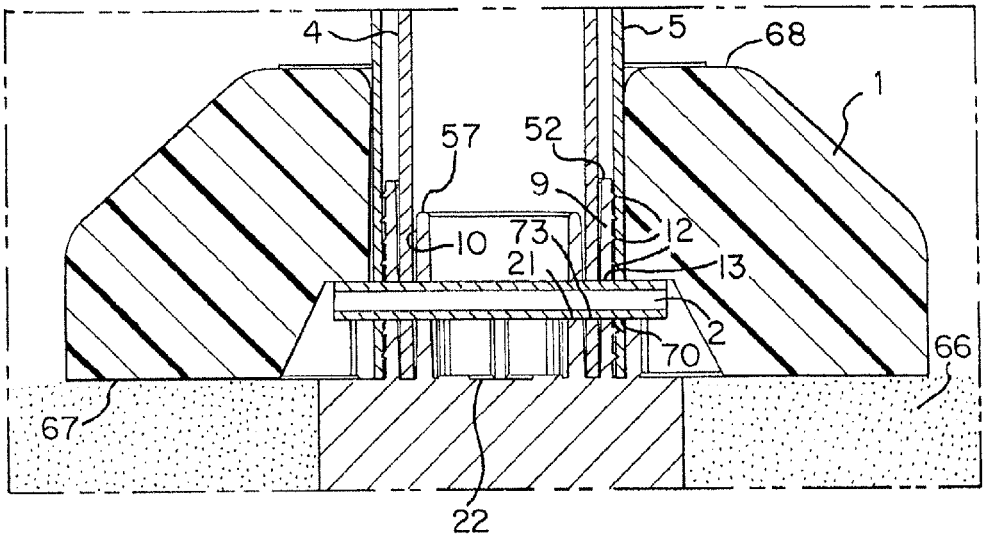
FIG. 9 is an enlarged detail view of FIG. 8.
Figure 8:
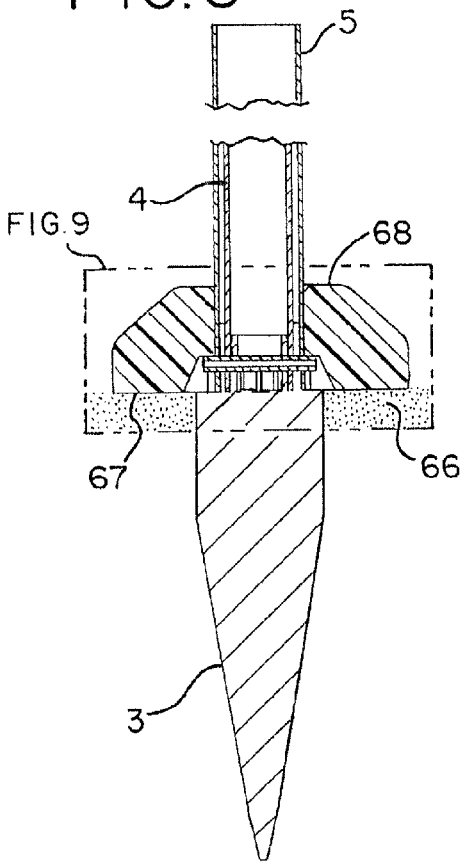
FIG. 8 is a cross-sectional view of the delineator assembly with support collar.

FIGS. 8 and 9, shows the flexible delineator assembly 8 with a protective support collar 1 and steel spring roll pin 2. The delineator pole(s) 4, 5 are secured to the anchor 3 with the steel spring roll pin 2. The cylindrical pin 2 is inserted into hole 70 in the outermost delineator pole 5, through hole 13 in the outer ring 9, through hole 73 in the inner delineator 4, then through hole 21 in the inner ring 10, then out through the opposing side of the assembly. Of course the pin 2 could be made from other materials, such as plastic. Or a plurality of pins 2 could be used to secure the delineator pole(s) to the anchor 3.

Figure 10:
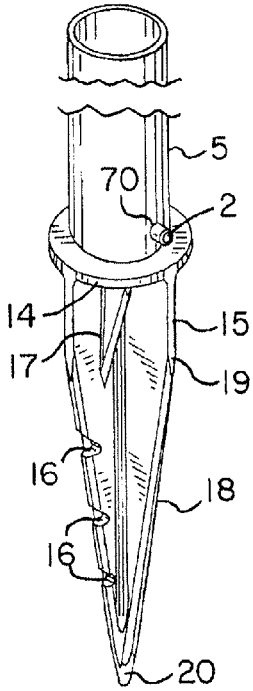
FIG. 10 is an isometric view of the delineator assembly without the support collar.

The addition of an anti-kinking protective support collar 1 over the receptacle section 50 of the anchor 3 can be used to provide additional support in the event that the delineator pole(s) 4, 5 is run over by a vehicle when the delineator system is in service. The support collar 1 has a top surface 68 and bottom surface 67 and is generally trapezoidal shaped. The support collar 1 provides a platform surface at the bending area of the delineator pole(s) to prevent the pole(s) 4, 5 from kinking so that the said pole(s) can return to its original substantially vertical position. Of course the flexible delineator assembly can be used without the support collar 1 as shown in FIG. 10. The top surface is generally dome shaped. The collar may be made from hard plastic, although it could be made out of metal or any other strong, rigid material.

Figure 11:
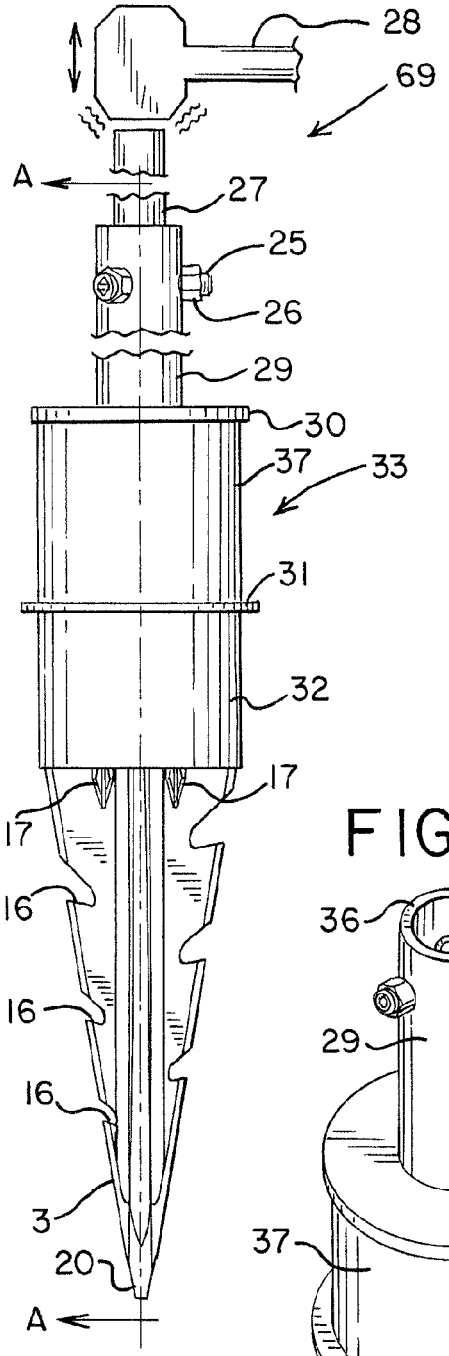
FIG. 11 is a front view of one installation method of the Anchor without the delineator assembly attached.
Figure 13:
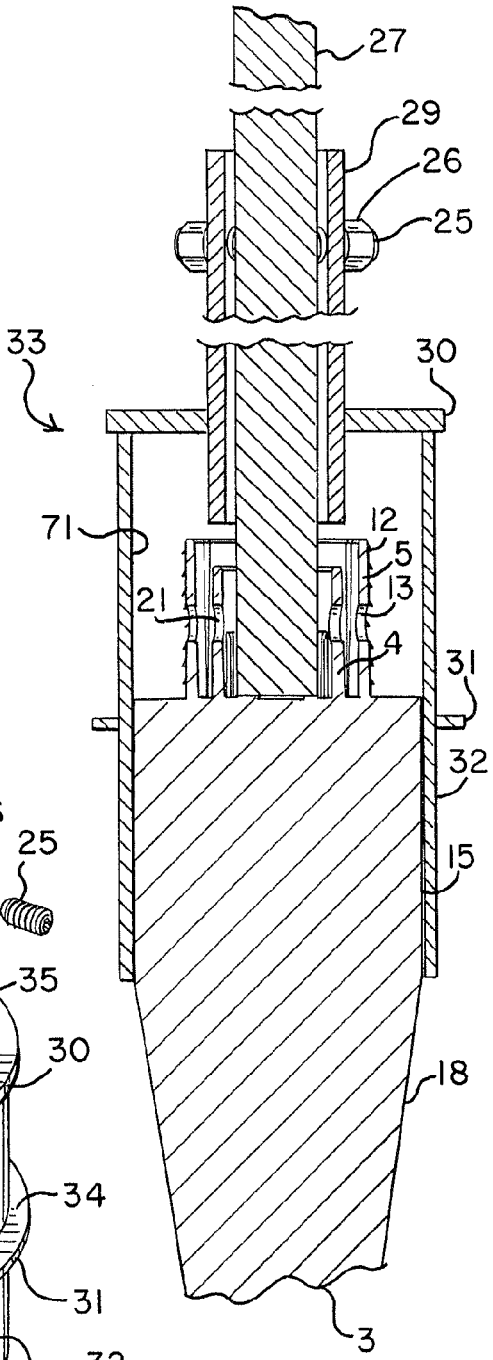
FIG. 13 is a cross-sectional view taken on the line A-A of FIG. 11.

Referring to FIGS. 11-13, shows one method of installation of the anchor 3. An anchor installation guide tool 33 is used to help drive the anchor 3 into the soil 66 by maintaining vertical alignment with the drive rod 27. The anchor installation guide tool 33 is generally shaped like a canister and consists of an upper guide stem tube 29 and lower guide tube 32, or collar, having a bottom edge and defining a cylindrical cavity. The guide stem tube 29 and lower guide tube/collar 32 are connected by means of a guide cap 30. The upper guide stem tube 29 is sized to fit the drive rod 27. The lower guide tube 32 has a larger diameter than the guide stem tube 29 and fits over the anchor 3. The above said parallel section 15 of the blades 64, 64*a*, 65, 65*a* of the anchor 3 rests on the inside wall 71 of the lower guide tube 32. An annular depth indicator ring 31 protrudes from the outer circumference of the lower guide tube 32. The depth indicator ring 31 is located such that the lower surface 63 of the planar disc 61 is aligned with the depth indicator ring 31 when the anchor 3 is inserted into the guide tool 33. This feature lets the installer know, and provides indicia, when the anchor 3 has reached its serviceable installation depth in the soil 66, with the indicator ring providing indicia that the anchor is at the proper location. The anchor installation guide tool 33 is made from steel, but other materials, such as aluminum or plastic could be used. The guide stem tube 29 fastens to drive rod 27 with three set screws 25, but other connection methods could be used, such as pinning or welding. In this way, the drive rod 27 is inserted into and extends downwardly into the cavity of the guide portion, with the distance between the bottom end of the drive rod 27 being adjustable relative to the bottom edge of the guide tube 32 or collar. In one embodiment, the depth indicator ring is positioned about 4 inches from the bottom of the lower guide tube and lets the installer know when the anchor has reached its serviceable installation depth in the soil. Of course, other depths may be suitable.

The anchor installation guide tool 33 is located on the drive rod 27 so that the top surface 36 of the upper guide stem tube 29 is positioned approximately six inches from the lower end of the drive rod 27. The anchor 3 is placed inside the canister guide tool assembly 33 where the drive rod 27 contacts the center of the planar disc 61. The assembly 69 is held vertically with anchor tip 20 contacting the ground 66, and then a hammer 28, or other force applying device, is used to strike the top of the drive rod 27. The drive rod 27 is struck repeatedly until the ground engaging section 51 of the anchor 3 is driven completely into the soil 66, with the depth indicator providing indicia that the anchor has been properly set. The drive rod may be configured as a piece of standard steel ¾ inch pipe in one embodiment.

Figure 14:
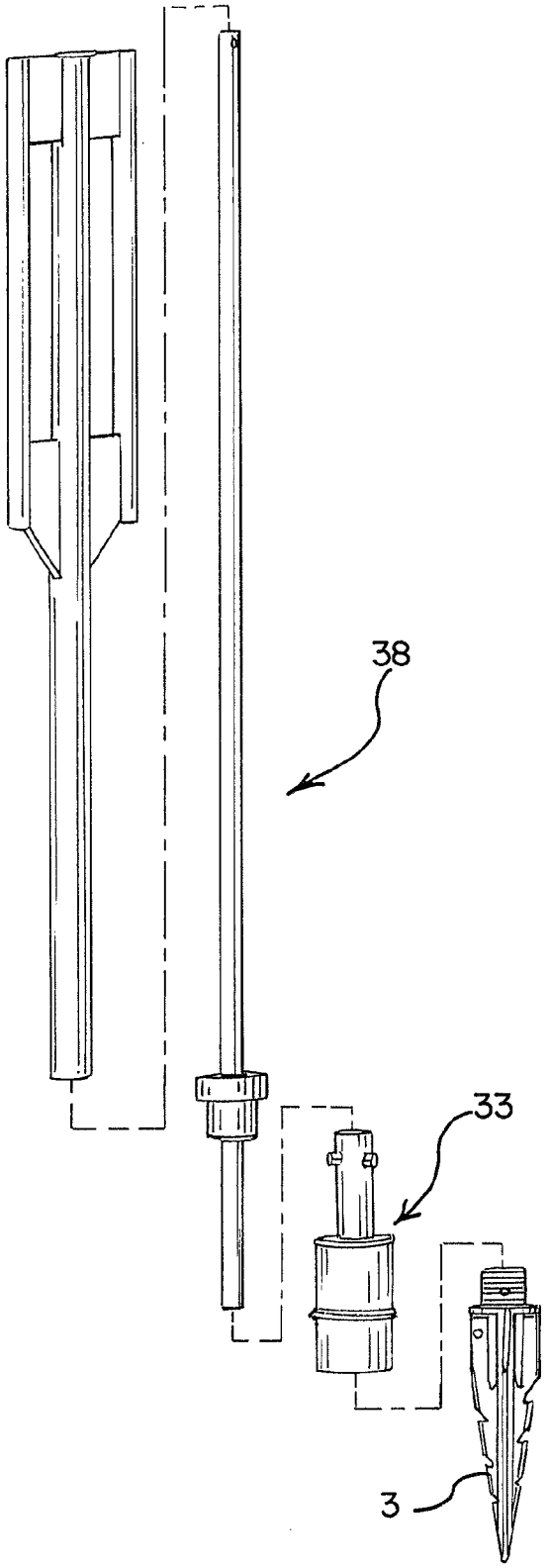
FIG. 14 is an exploded view of another installation method of the Anchor without the delineator assembly attached.
Figure 15:
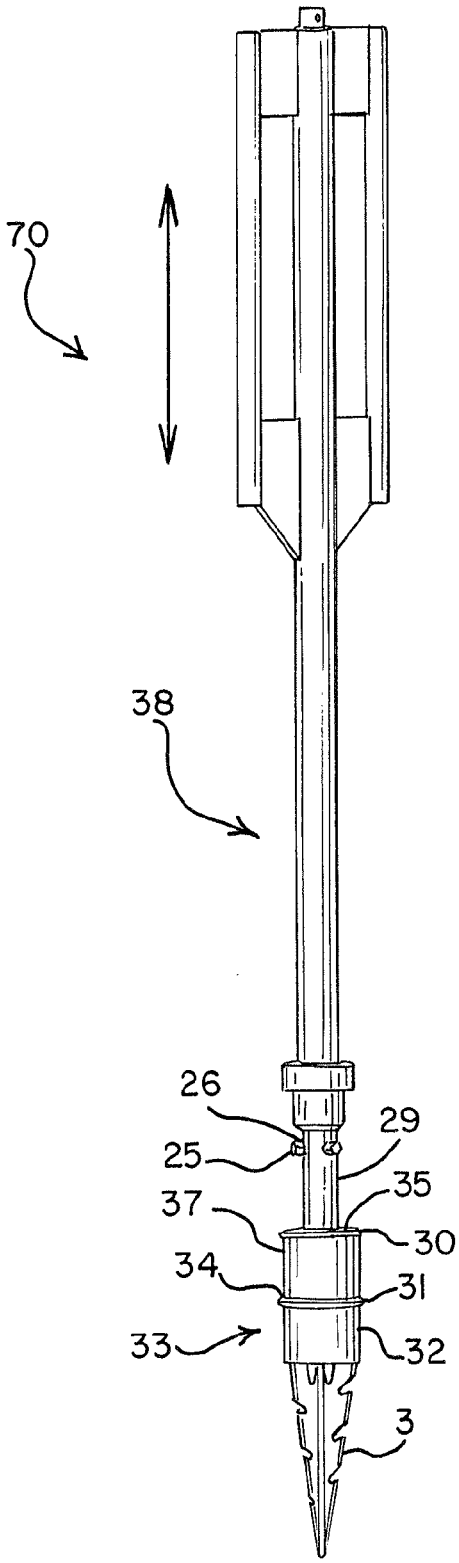
FIG. 15 is an isometric view of another installation method of the Anchor without the delineator assembly attached.

In yet another embodiment as shown in FIGS. 14 and 15, another method of installing the anchor 3 is shown. In this embodiment, the anchor 3 utilizes the soil anchor driving tool 38 manufactured by Safe-Hit®, a division of Energy Absorption Systems, A Trinity Industries Company. With this device, the guide stem tube 29 of the canister guide tool 33 is secured to the lower stem rod of the Safe-hit driver tool 38 with set screws 25. The driver assembly 70 is held vertically with the anchor tip 20 contacting the ground 66 and then Safe-Hit driver tool 38 is moved up and down in a similar fashion as a fence post driver, until the anchor is completely set into the ground. One suitable soil anchor driving tool is p/n SHTOL-30-6-X as manufactured by Safe-Hit®, a division of Energy Absorption Systems, A Trinity Industries Company. Apart from the above mentioned methods there are other methods to drive the anchor into the soil. For example, to help install anchors in hard soil, a hole may be created that is slightly smaller than the outside diameter of the anchor. Such holes are commonly referred to as pilot holes. The anchor can then be easily embedded into the soil by means of a hammer Motorized tools like jackhammer or piston cylinder hammer can also be used for anchor installation.

Figure 16:
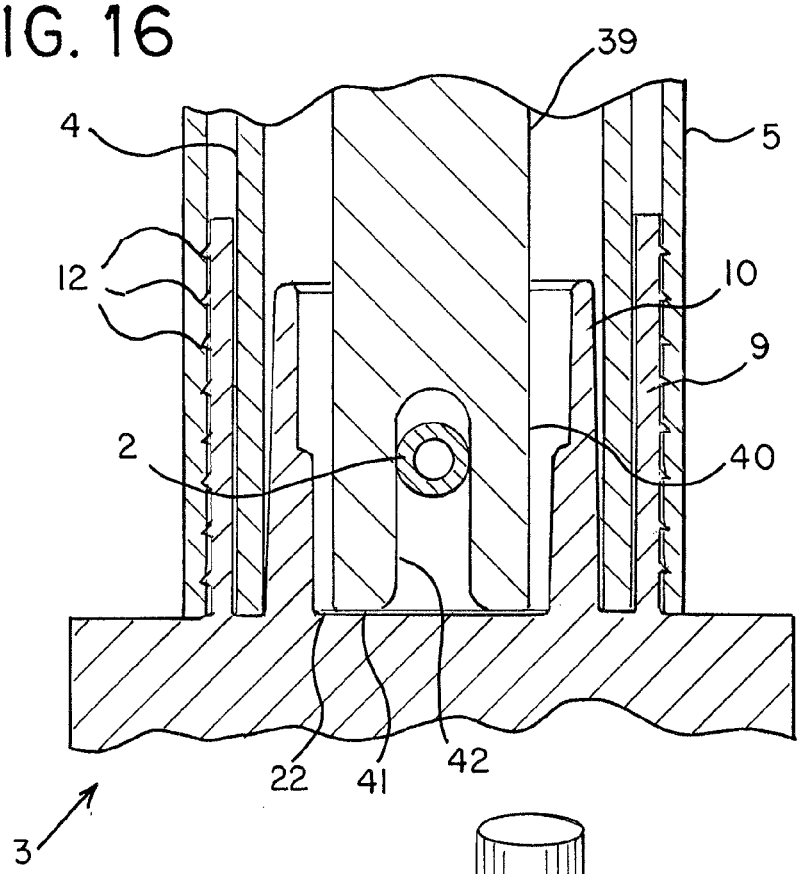
FIG. 16 is a cross section view of yet another installation method of the Anchor with the delineator assembly attached.
Figure 17:
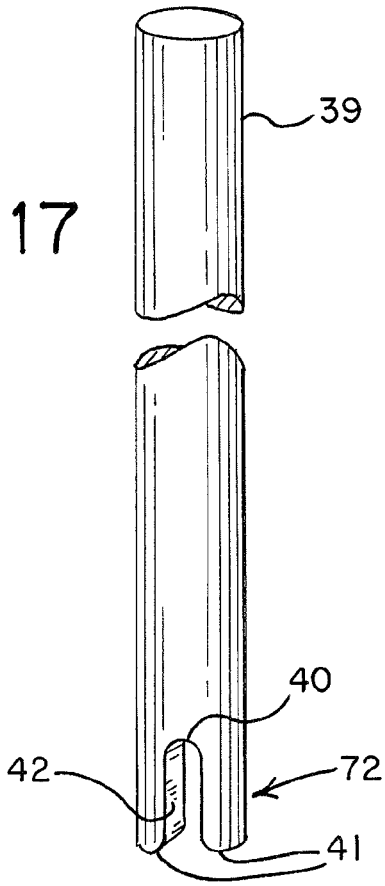
FIG. 17 is an isometric view of the drive rod with notch.

The former described anchor installation methods are directed to installing the anchor 3 before the delineator pole (s) 4, 5 are attached to the anchor. FIGS. 16 and 17 show one method to install the complete anchor/delineator assembly 8 into soil as a single unit. This can be done with the help of a long drive rod 39 that protrudes above the top of the delineator (s). The drive rod 39 is placed into the open end of the delineator assembly so that the notched end 72 contacts the driving platform projections 22 of the anchor 3. To provide clearance for the delineator pole securing pin 2, the lower end 72 of the long drive rod 39 has a notch or groove 40 formed in one an end thereof, which allows the drive rod 39 to straddle the steel spring roll pin 2. The bottom end 41 of the drive rod 39 contacts the surface of the projections 22, which are located on the top surface 60 of the planar disc 61 on the inside of the inner ring 10 as shown in FIG. 6.

Figure 18:
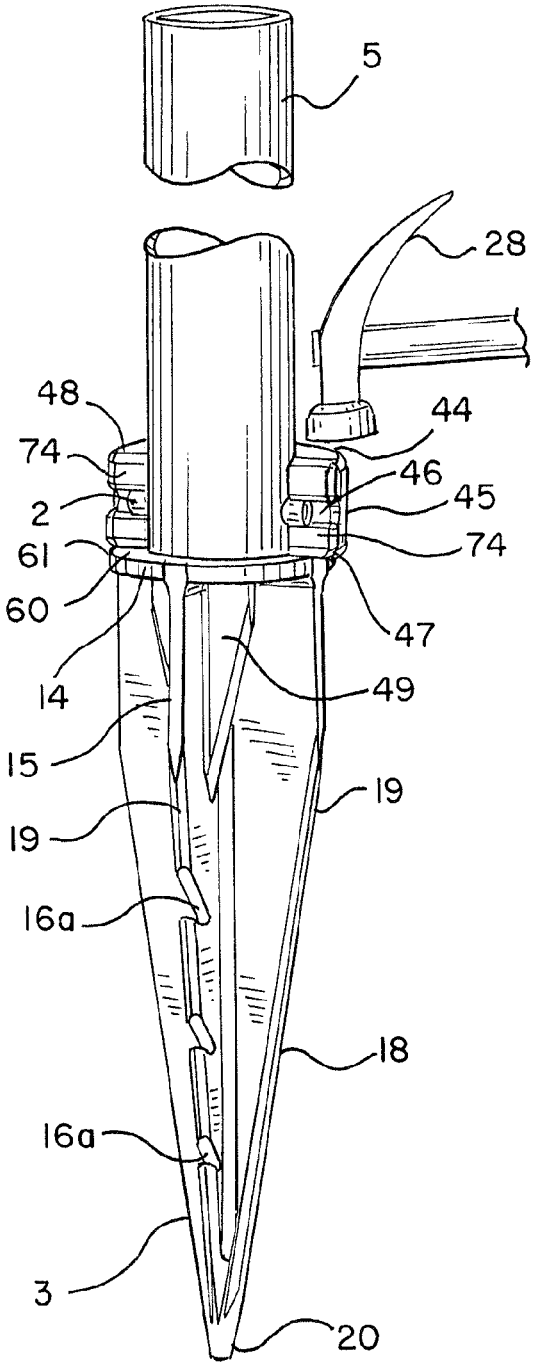
FIG. 18 is an isometric front view of yet another installation method of the Anchor with the delineator assembly attached.
Figure 19:
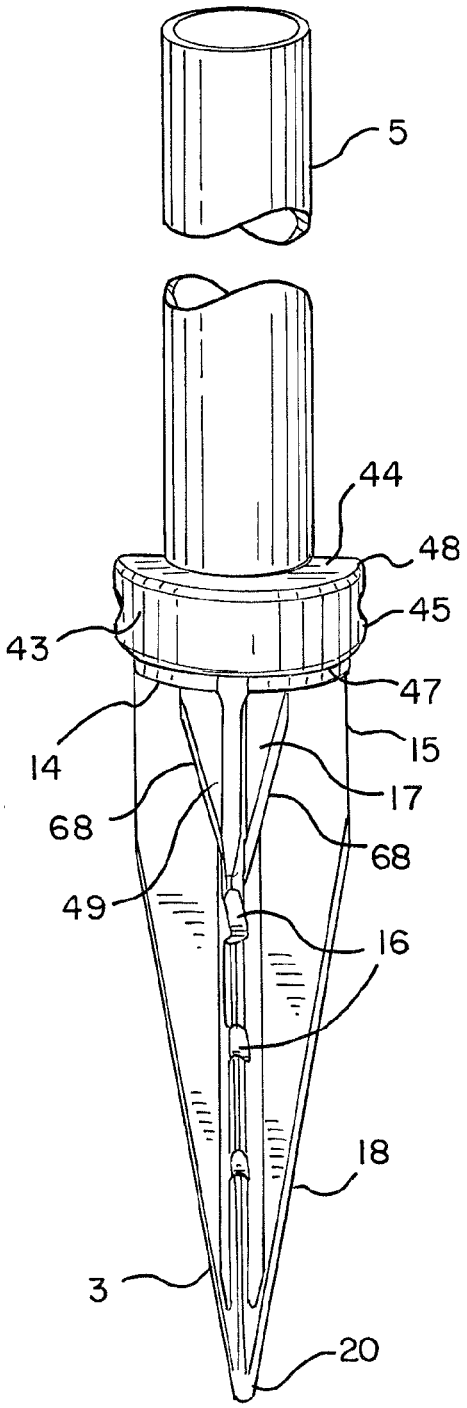
FIG. 19 is an isometric rear view of FIG. 18.

Turning our attention to FIGS. 18 and 19 is another method to install the complete anchor/delineator assembly 8 into soil as a single unit is presented. In this method a semi-circular sleeve 43 has an inner diameter slightly larger than the outside diameter of the delineator pole outer securing ring 9. A notch 46 is provided on both vertical flat surfaces 74 of the sleeve 43 to provide clearance for the delineator pole securing pin 2. The drive sleeve 43 is placed onto the delineator assembly 8 so that the bottom surface 47 of the sleeve 43 contacts the top surface 60 of the planar disc 61. Then the top surface 44 of the sleeve 43 is struck repeatedly with a hammer 28 until the assembly 8 is installed into the ground 66. This installation method and the formerly described installation method were presented using manually operated tools. It should be noted that electrically, hydraulically or pneumatically powered tools could also be used.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A ground anchor for a delineator, the ground anchor comprising:

a unitary plastic body comprising:

a receptacle shaped and configured for connection to a delineator post; and a ground engaging portion extending from said receptacle along a longitudinal axis, said ground engaging portion comprising a plurality of tapered blades each having a linear edge, wherein at least two of said tapered blades each comprise at least one cutout interrupting and extending inwardly from said linear edge and defining at least one barb, wherein said linear edge is positioned on and extends from opposite sides of said cutout, wherein said at least one barb defined on each of said at least two tapered blades does not extend outwardly from said linear edge of said blade, and wherein said at least one barb on one of said at least two blades is longitudinally offset from said at least one barb on the other of said at least two tapered blades along said longitudinal axis, and wherein said at least one barb on said one of said at least two tapered blades is not longitudinally aligned with any barbs on said other of said at least two tapered blades.

2. The ground anchor of claim 1 wherein said receptacle comprises a pair of concentric cylinders.

3. The ground anchor of claim 1 wherein said receptacle defines a drive platform lying substantially perpendicular to said longitudinal axis.

4. The ground anchor of claim 3 wherein said drive platform comprises a plurality of projections.

5. The ground anchor of claim 3 wherein said unitary plastic body further comprises a reinforcing structure disposed beneath said drive platform.

6. The ground anchor of claim 5 wherein said reinforcing structure comprises a plurality of ribs disposed between at least some of said plurality of tapered blades.

7. The ground anchor of claim 1 wherein said plurality of tapered blades extend radially from a central axis and are tapered along the longitudinal axis to form a terminal point.

8. The ground anchor of claim 1 wherein at least some of said plurality of tapered blades are chamfered along an outer edge.

9. The ground anchor of claim 1 wherein said tapered blades each comprise a lower portion having a tapered edge and an upper portion having a non-tapered edge extending parallel to said longitudinal axis.

10. A delineator assembly comprising:

a ground anchor comprising a unitary plastic body comprising a receptacle and a ground engaging portion extending from said receptacle along a longitudinal axis, said ground engaging portion comprising a plurality of tapered blades each having a linear edge, wherein at least two of said tapered blades each comprise at least one cutout interrupting and extending inwardly from said linear edge and defining at least one barb, wherein said linear edge is positioned on and extends from opposite sides of said cutout, wherein said at least one barb defined on each of said at least two tapered blades does not extend outwardly from said linear edge of said blade, and wherein said at least one barb on one of said at least two blades is longitudinally offset from at least one barb on the other of said at least two tapered blades along said longitudinal axis, and wherein said at least one barb on said one of said at least two tapered blades is not longitudinally aligned with any barbs on said other of said at least two tapered blades; and a delineator post coupled to and extending from said receptacle along said longitudinal axis.

11. The delineator assembly of claim 10 wherein said receptacle comprises inner and outer concentric cylinders, and wherein said delineator post comprises a first tube disposed between said cylinders, inside said inner cylinder, or outside said outer cylinder.

12. A delineator assembly comprising:

a ground anchor comprising a unitary plastic body comprising a receptacle and a ground engaging portion extending from said receptacle along a longitudinal axis, said receptacle comprising inner and outer concentric cylinders, and said ground engaging portion comprising a plurality of tapered blades having an edge, wherein at least two of said blades comprise at least one cutout defining at least one barb, wherein said at least one barb defined on each of said at least two blades does not extend outwardly from said edge of said blade, and wherein said at least one barb on said at least two blades are longitudinally offset along said longitudinal axis; and a delineator post coupled to and extending from said receptacle along said longitudinal axis, wherein said delineator post comprises a first tube disposed between said cylinders or inside said inner cylinder, and further comprising a second tube disposed between said cylinders or outside of said outer cylinder.

13. The delineator assembly of claim 10 wherein said receptacle defines a drive platform lying substantially perpendicular to said longitudinal axis.

14. The delineator assembly of claim 13 wherein said drive platform comprises a plurality of projections.

15. The delineator assembly of claim 13 wherein said unitary body further comprises a reinforcing structure disposed beneath said drive platform.

16. The delineator assembly of claim 15 wherein said reinforcing structure comprises a plurality of ribs disposed between at least some of said plurality of tapered blades.

17. The delineator assembly of claim 10 wherein said plurality of tapered blades extend radially from a central axis and are tapered along the longitudinal axis to form a terminal point.

18. The delineator assembly of claim 17 wherein at least some of said plurality of tapered blades are chamfered along an outer edge.

19. The delineator assembly of claim 10 wherein said tapered blades each comprise a lower portion having a tapered edge and an upper portion having a non-tapered edge extending parallel to said longitudinal axis.

20. The delineator of claim 12 wherein said first tube is disposed between said cylinders and said second tube is disposed outside of said outer cylinder, wherein said first tube is nested in said second tube.

21. The delineator of claim 20 wherein said first tube is shorter than said second tube.

22. A method of installing a ground anchor for a delineator post, the method comprising:

providing a ground anchor comprising a unitary plastic body comprising:

a receptacle shaped and configured for connection to a delineator post, said receptacle comprising a driving platform; and a ground engaging portion extending from said receptacle along a longitudinal axis, said ground engaging portion comprising a plurality of tapered blades each having a linear edge, wherein at least two of said tapered blades each comprise at least one cutout interrupting and extending inwardly from said linear edge and defining at least one barb, wherein said linear edge is positioned on and extends from opposite sides of said cutout, wherein said at least one barb defined on each of said at least two tapered blades does not extend outwardly from said linear edge of said blade, and wherein said at least one barb on one of said at least two blades is longitudinally offset from said at least one barb on the other of said at least two tapered blades along said longitudinal axis, and wherein said at least one barb on said one of said at least two tapered blades is not longitudinally aligned with any barbs on said other of said at least two tapered blades;

positioning said ground engaging portion at a targeted location on a ground surface; and applying a force with a driving tool against said driving platform and thereby driving said ground engaging portion into said ground.

23. The method of claim 22 wherein said drive platform comprises a plurality of projections, and wherein said applying said force with said driving tool comprises applying said force to said projections.

24. The method of claim 22 wherein said ground anchor further comprises a reinforcing structure disposed beneath said drive platform.

25. The method of claim 22 further comprising providing a delineator post coupled to said receptacle of said ground anchor, and wherein said applying said force with said driving tool against said driving platform comprises inserting said driving tool through said delineator post and into engagement with said driving platform.

26. The method of claim 25 wherein said delineator post is coupled to said receptacle with a laterally extending fastener, and wherein an end portion of said driving tool comprises a groove shaped to receive said fastener as an end of said driving tool is engaged with said driving platform.

27. The method of claim 25 wherein said driving tool comprises a collar disposed around an outside of said post, wherein said collar has an upper surface suitable for receiving a force applying tool and a bottom surface engaging said driving platform.

28. A method of installing a ground anchor for a delineator post, the method comprising:

providing a ground anchor comprising a unitary plastic body comprising:

a receptacle shaped and configured for connection to a delineator post, said receptacle comprising a driving platform; and a ground engaging portion extending from said receptacle along a longitudinal axis, said ground engaging portion comprising a plurality of tapered blades having an edge, wherein at least two of said blades comprise at least one cutout defining at least one barb, wherein said at least one barb defined on each of said at least two blades does not extend outwardly from said edge of said blade, and wherein said at least one barb on each of said at least two blades are longitudinally offset along said longitudinal axis, and wherein said tapered blades each comprise a lower portion having a tapered edge and an upper portion having a non-tapered edge extending parallel to said longitudinal axis;

positioning said ground engaging portion at a targeted location on a ground surface;

locating a driving tool relative to said ground anchor, wherein said locating said driving tool comprises surrounding said upper portion with a collar; and applying a force with a driving tool against said driving platform and thereby driving said ground engaging portion into said ground.

29. The method of claim 28 wherein said driving said ground engaging portion into said ground further comprises driving said ground engaging portion into said ground until an indicator disposed on said collar is located proximate a surface of said ground and thereafter removing said driving tool.

30. The method of claim 29 wherein said indicator is positioned proximate a top of said ground engaging portion when said collar surrounds said upper portion and said driving tool is engaged with said driving platform.

* * * * *